US009072939B2

(12) United States Patent
Silagy et al.

(10) Patent No.: US 9,072,939 B2
(45) Date of Patent: Jul. 7, 2015

(54) MECHANICAL HAND AND FINGER EXERCISER

(71) Applicants: Robert Silagy, Merrick, NY (US); Dennis Waldman, Waban, MA (US)

(72) Inventors: Robert Silagy, Merrick, NY (US); Dennis Waldman, Waban, MA (US)

(73) Assignee: COGNATUS INNOVATIONS LLC, Waban, MA (US)

( * ) Notice: Subject to any disclaimer, the term of this patent is extended or adjusted under 35 U.S.C. 154(b) by 188 days.

(21) Appl. No.: 13/955,447

(22) Filed: Jul. 31, 2013

(65) Prior Publication Data

US 2014/0038785 A1 Feb. 6, 2014

Related U.S. Application Data

(60) Provisional application No. 61/678,348, filed on Aug. 1, 2012.

(51) Int. Cl.

| | |
|---|---|
| ***A63B 23/16*** | (2006.01) |
| ***A63B 21/055*** | (2006.01) |
| ***A63B 23/035*** | (2006.01) |
| ***A63B 21/04*** | (2006.01) |
| *A63B 71/06* | (2006.01) |
| *A63B 21/00* | (2006.01) |

(52) U.S. Cl.

CPC ..... *A63B 23/16* (2013.01); *A63B 21/0552* (2013.01); *A63B 23/03508* (2013.01); *A63B 21/0428* (2013.01); *A63B 2071/0694* (2013.01); *A63B 21/00065* (2013.01); *A63B 21/00061* (2013.01)

(58) Field of Classification Search

CPC ..... A63B 23/16; A63B 21/05

See application file for complete search history.

(56) References Cited

U.S. PATENT DOCUMENTS

| | | | | |
|---|---|---|---|---|
| 689,652 | A * | 12/1901 | Perry | 482/49 |
| 3,738,651 | A | 6/1973 | Norman et al. | |
| 4,433,683 | A | 2/1984 | McCoy et al. | |
| 4,934,024 | A | 6/1990 | Sexton | |

(Continued)

FOREIGN PATENT DOCUMENTS

WO WO 2007/035364 3/2007

OTHER PUBLICATIONS

Prohands Hand Exerciser by Prohands (1 page), www.prohands.net/products, visited on Jan. 25, 2013.

(Continued)

*Primary Examiner* — Loan H Thanh
*Assistant Examiner* — Rae Fischer
(74) *Attorney, Agent, or Firm* — Carter, DeLuca, Farrell & Schmidt, LLP

(57) ABSTRACT

A hand and finger exerciser having a frame, and a slide configured to move vertically with respect to the frame. In an example embodiment, the frame includes an upper cross-member, a pair of vertical supports extending downward from the upper cross-member, and a base fixed to a lower portion of the vertical supports. The slide includes an upper cross-member having a pair of guides extending downward from the upper cross-member. The guides are configured to slidably engage the vertical supports of the frame to enable the slide to move vertically with respect to the frame. An axle extends between the lower portions of the vertical supports and includes a plurality of finger rollers rotatable about the axle. Each of the plurality of finger rollers are free to move horizontally along at least a portion of the axle.

12 Claims, 7 Drawing Sheets

(56) References Cited

U.S. PATENT DOCUMENTS

| | | | |
|---|---|---|---|
| 5,076,569 | A | 12/1991 | Gootter |
| 5,147,256 | A | 9/1992 | Silagy |
| D352,754 | S | 11/1994 | Silagy |
| 5,403,008 | A | 4/1995 | Mainiero |
| 5,431,611 | A | 7/1995 | Silagy |
| 5,440,784 | A | 8/1995 | Hull et al. |
| 5,580,335 | A | 12/1996 | Smith, IV |
| 5,674,185 | A | 10/1997 | Chang |
| 5,797,165 | A | 8/1998 | Armbrust |
| 5,820,522 | A | 10/1998 | Smallwood et al. |
| 6,007,460 | A | 12/1999 | Young |
| 6,835,169 | B2 | 12/2004 | Tamaribuchi |
| 7,306,615 | B2 | 12/2007 | Wilson |
| 7,351,897 | B2 | 4/2008 | Woods |
| RE40,324 | E | 5/2008 | Crawford |
| 7,381,156 | B2 | 6/2008 | Silagy |
| 7,523,525 | B2 | 4/2009 | Lawless |
| 2007/0060448 | A1 | 3/2007 | Silagy |

OTHER PUBLICATIONS

Planet Waves Varigrip Hand Exerciser by Planet Waves (5 pages), http://www.amazon.com/Planet-Waves-Varigrip-Adjustable-Exerciser/dp/B001OCGGEM, visited on Jan. 25, 2013.

Portable Green Light Tension Guitar Extend-O-Grip Hand Exerciser by Flanger (3 pages), http://www.amazon.com/Portable-Tension-Guitar-Extend-O-Grip-Exerciser/dp/B00950VC5Y/ref=sr__1__6?s=musical-instruments&ie=UTF8&qid=135877738&sr=1-6&keywords=hand+exerciser, visited on Jan. 25, 2013.

Portable Black Medium Tension Guitar Extend-O-Grip Hand Exerciser by Flanger (4 pages), http://www.amazon.com/Portable-Medium-Tension-Extend-O-Grip-Exerciser/dp/B00950N2RU/ref=sr__1__3?s=musical-instruments&ie=UTF8&qid=1358777378&sr=1-3&keywords=hand+exerciser, visited on Jan. 25, 2013.

ENO EHF-01 Instruments Plastic Finger Training Device—Green by ENO (3 pages), http://dx.com/p/eno-ehf-01-instrument-plastic-finger-training-device-green-157865, visited on Jan. 25, 2013.

Everlast Hand & Finger Strengthener by Everlast (4 pages), http://www.amazon.com/Everlast-EX3782YE-aka-EV3782YE-Strengthener/dp/B0013N4BVM/ref=sr__1__77?ie=UTF8&qid=1358777888&sr=8-77&keywords=finger+exerciser, visited on Jan. 25, 2013.

Ruff Rider Ruff Grip Callus Builder Caps (Standard) by Ruff Rider (5 pages), http://www.amazon.com/Ruff-Rider-Callus-Builder-Standard/dp/B0001H0N26/ref=sr__1__15?ie=UTF8&qid=1358777750&sr=8-15&keywords=finger+exerciser, visited on Jan. 25, 2013.

* cited by examiner

MECHANICAL HAND AND FINGER EXERCISER

CROSS-REFERENCE TO RELATED APPLICATION

This application claims priority from, and the benefit of, U.S. Provisional Application Ser. No. 61/678,348, filed Aug. 1, 2012, the entirety of which is hereby incorporated by reference herein for all purposes.

BACKGROUND

1. Technical Field

The present disclosure relates to an improved hand and finger exerciser of the type in which engaged elements or components are pressed against the resistance or urgency of elastomeric bands. Embodiments of the disclosed hand and finger exerciser allow exercise of the hand, all fingers simultaneously, or each finger individually.

2. Description of Related Art

Finger exercising devices have found widespread use in strength and endurance training applications, as well as in therapeutic applications to overcome physiological dysfunction and injury. Various type of finger and hand exercise devices have been developed, such as a large v-spring having handles on either leg which are held in the hand and repeatedly squeezed together. Another device features two parallel handles which are urged apart by an arrangement of spring or elastomeric bands which are grasped between the thumb and forefingers and squeezed together. Yet another style of hand exerciser features individual spring-activated plungers and an opposing spring activated palm rest. Still others utilize a wristband or glove arrangement having an array of elastomeric tethers running from the fingers to an anchor point. Various other shapes and styles of squeezable foam rubber devices have also been used.

Conventional hand and finger exercise devices may have drawbacks, because the range of exercises available to the user is severely limited by the design of the unit.

SUMMARY

The present disclosure is directed to an improved finger exerciser. In an example embodiment, the disclosed finger exerciser includes a frame and a slide configured to move vertically with respect to the frame. The frame includes an upper cross-member, a pair of vertical supports extending downward from the upper cross-member, and a base fixed to a lower portion of the vertical supports. The slide includes an upper cross-member having a pair of guides extending downward from the upper cross-member. The guides are configured to slidably engage the vertical supports of the frame to enable the slide to move vertically with respect to the frame. The finger exerciser includes one or more first posts extending upwardly from the upper cross-member of the frame, and one or more second posts extending downwardly from the upper cross-member of the slide.

In some embodiments, the base of the finger exerciser includes an ergonomic groove defined therein that is configured to receive the base of a user's thumb and/or a thumb groove defined therein configured to provide an additional grasping surface. In some embodiments, the base is selectively detachable from the pair of vertical supports. In some embodiments, the base includes one or more flats formed on either end of a bottom surface thereof to enable the finger exerciser to stand upright.

In yet other embodiments, the finger exerciser includes a plurality of notches defined in at least one of the pair of vertical supports, and an adjustable stopper operatively associated with the at least one of the pair of vertical supports. The adjustable stopper may include a pawl configured to selectively engage one of the plurality of notches.

In still other embodiments, the finger exerciser includes an axle disposed between the lower portions of the vertical supports and a plurality of finger rollers rotatable about the axle. The plurality of finger rollers may include a pair of inner finger rollers and a pair of outer finger rollers having a diameter that is smaller than a corresponding diameter of the inner finger rollers. In some embodiments, each of the plurality of finger rollers includes a saddle-like profile. In some embodiments, each of the plurality of finger rollers are free to move horizontally along at least a portion of the axle.

In yet other embodiments, the finger exerciser includes a rigid grip assembly disposed between the lower portions of the vertical supports. In some embodiments, the rigid grip assembly includes a plurality of finger pads. In some embodiments, the plurality of finger pads further comprises two inner finger pads, two outer finger pads having a height less than a corresponding height of the two inner pads.

In another example embodiment, a finger exerciser in accordance with the present disclosure includes a frame, a slide assembly configured to move vertically with respect to the frame, and an individual finger exerciser mounted in a subslide assembly. The subslide assembly is configured to move horizontally with respect to the slide assembly. The finger exerciser frame includes an upper cross-member having a pair of vertical supports extending downward therefrom, a base fixed to a lower portion of the vertical supports, and one or more frame posts extending upwardly from the upper cross-member of the frame.

The slide assembly includes upper and lower cross-rails and a pair of guides extending downward from the upper cross-rail to the lower cross-rail configured to slidably engage the vertical supports of the frame to enable the slide assembly to move vertically with respect to the frame.

The at least one individual finger exerciser includes a subframe configured for horizontal movement along the upper and lower cross-rails. In some embodiments, the subframe includes comprises an upper subframe guide configured for horizontal movement along the upper cross-rail, a lower subframe guide configured for horizontal movement along the lower cross-rail, and a pair of vertical subframe rails extending from respective ends of the upper subframe guide to corresponding ends of the lower subframe guide.

The at least one individual finger exerciser includes a subslide having a horizontal subslide upper member, a finger roller, and a pair of vertical subslide guides extending downward from the horizontal subslide upper member to the finger roller, wherein the vertical subslide guides are configured to slidably engage the vertical subframe rails of the subframe to enable the subslide assembly to move vertically with respect to the subframe. In some embodiments, the at least one individual finger exerciser further comprises a slide post extending downward from the upper subframe guide. The slide post and the one or more frame posts are configured to support an elastomeric band disposed therebetween.

In some embodiments, the disclosed finger exerciser includes a plurality of notches defined in at least one of the pair of vertical supports, and an adjustable stopper operatively associated with the at least one of the guides, the adjustable stopper configured to selectively engage one of the plurality of notches to lock the slide assembly in place.

BRIEF DESCRIPTION OF THE DRAWINGS

Example embodiments in accordance with the present disclosure are described herein with reference to the drawings wherein.

DETAILED DESCRIPTION

Figure 1:
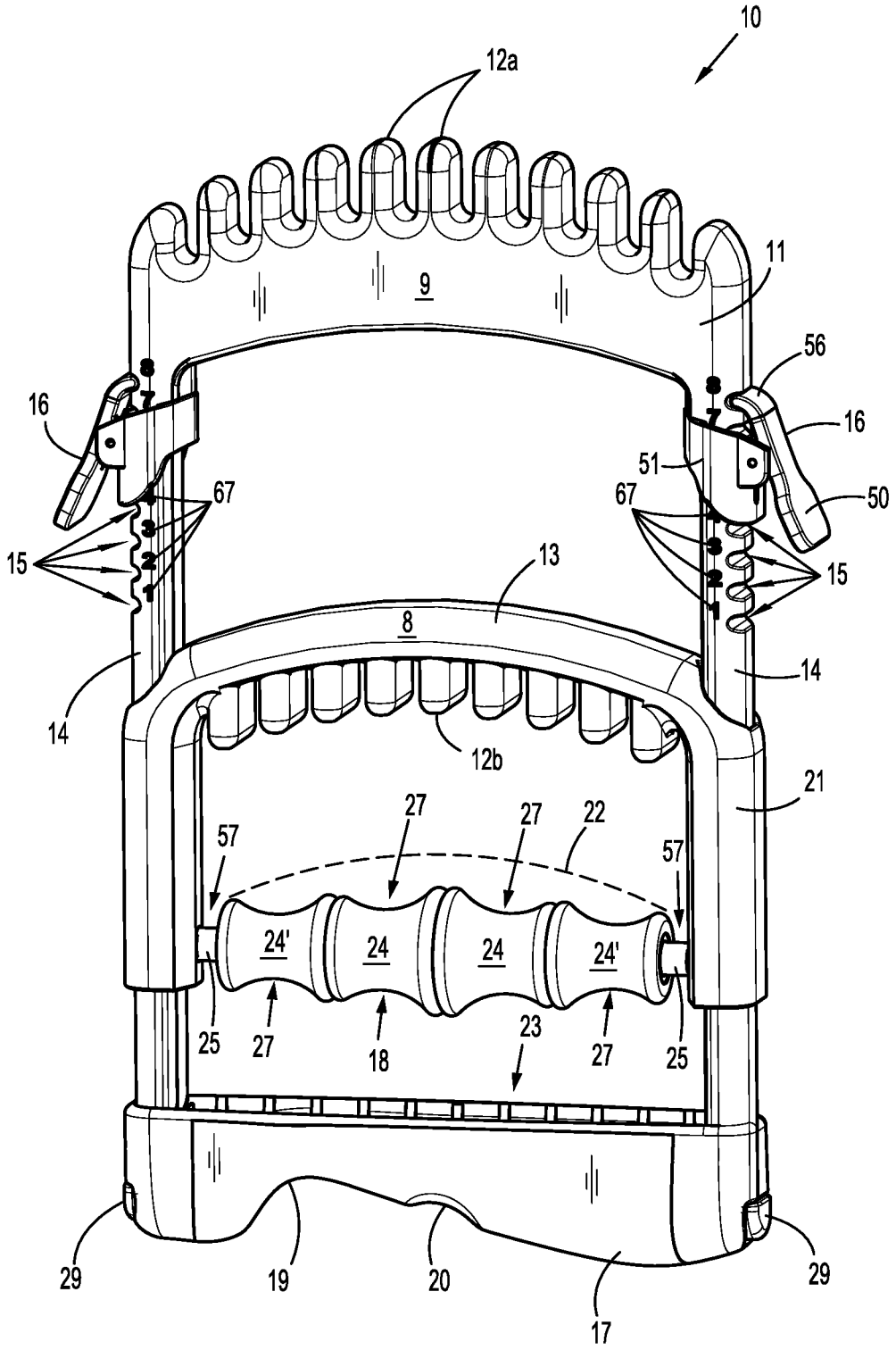
FIG. 1 is a perspective view of an embodiment of an improved finger exerciser with a finger roller attachment in accordance with the present disclosure.

Particular embodiments of the present disclosure are described hereinbelow with reference to the accompanying drawings; however, it is to be understood that the disclosed embodiments are merely examples of the disclosure, which may be embodied in various forms. Well-known and/or repetitive functions and constructions are not described in detail to avoid obscuring the present disclosure in unnecessary or redundant detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In addition, as used herein in the description and in the claims, terms referencing orientation, e.g., "top", "bottom", "upper", "lower", "left", "right", and the like, are used with reference to the figures and features shown and described herein. It is to be understood that embodiments in accordance with the present disclosure may be practiced in any orientation without limitation. In this description, as well as in the drawings, like-referenced numbers represent elements which may perform the same, similar, or equivalent functions.

With reference to FIG. 1, an improved hand and finger exerciser 10 is presented. Exerciser 10 includes a frame 11 on which a slide 13 is mounted and configured for vertical motion. Frame 11 includes a pair of vertical supports 14 which extend downwardly from either side of an upper cross-member 9, and which are fixed to a base 17. In some embodiments, vertical supports 14 are selectively attachable to base 17 enabling base 17 to be removed to facilitate reconfiguration of exerciser 10 as described herein. A mechanical interface 29 between vertical support 14 and base 17 enables a user to selectively release and engage vertical support 14 and base 17.

Figure 2:
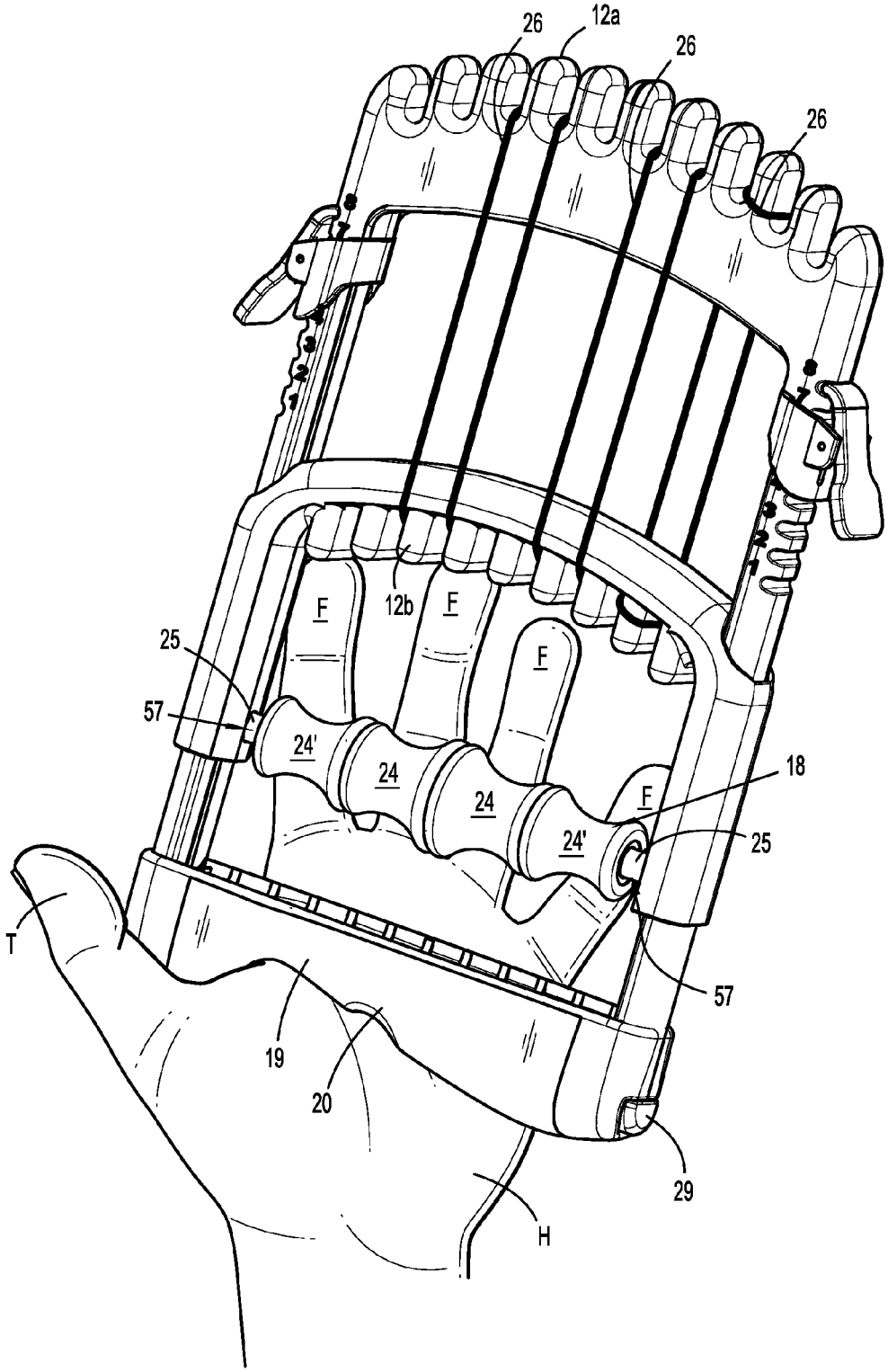
FIG. 2 is a perspective view of the improved finger exerciser of FIG. 1 in use.

Base 17 includes a number of ergonomic features configured to improve a user's grasp, to provide increased comfort, and to facilitate use of the exerciser 10. Base 17 includes an ergonomic groove 19 defined therein that is configured to receive the base of a user's thumb (FIG. 2). Base 17 also includes a thumb groove 20 defined therein that provides an additional grasping surface which may be utilized in various ways. For example, and without limitation, a user may place a fingertip or thumbtip in thumb groove 20 while performing "pinch" exercises in cooperation with one or more opposing fingers.

Figure 5:
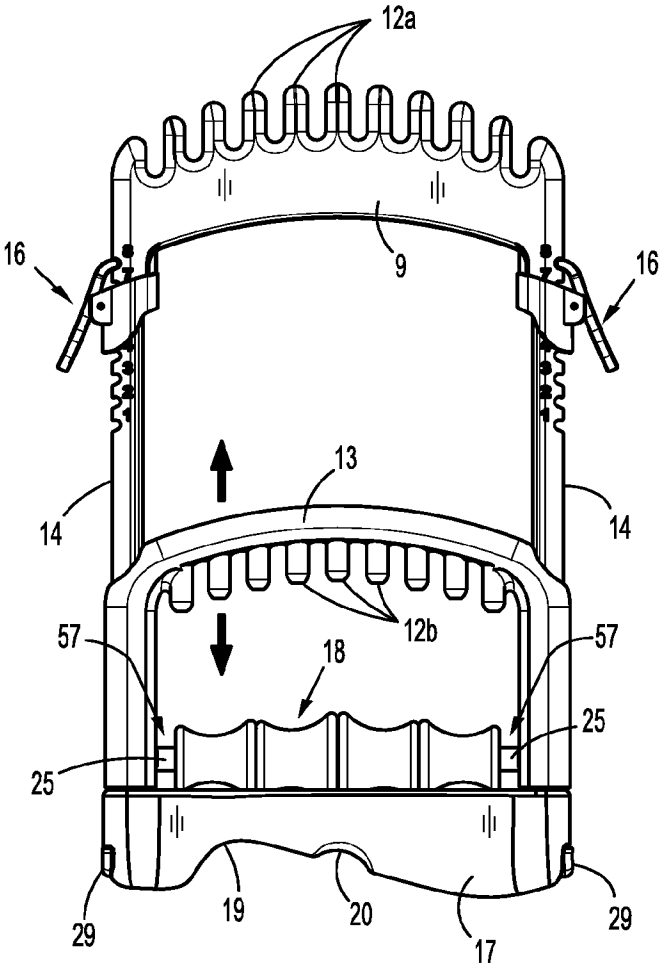
FIG. 5 is a front view of the improved finger exerciser of FIG. 1 showing a finger roller attachment and ergonomic base.

Base 17 also includes a base groove 23 defined in an upper surface thereof. Base groove 23 provides clearance for finger rollers 24 when slide 13 is fully extended in the down-most position, as shown in FIG. 5.

Slide 13 includes an upper cross-member 8. A pair of guides 21 extend downward from upper cross-member 8 that are configured to slidably engage vertical supports 14 to enable slide 13 to move up and down with respect to frame 11. In the embodiment illustrated in FIG. 1, guide 21 includes a tube-like structure which surrounds vertical support 14, and guides slide 13 therealong during use. In some embodiments, the tube-like structure of guide 21 completely encircles vertical support 14 (e.g., guide 21 surrounds vertical support 14 around 360° of its circumference). In some embodiments, guide 21 may employ a channel (e.g., a U-shaped cross section), a protrusion extending into a corresponding groove provided in vertical support 14 (not explicitly shown), or one or more wheels or roller bearings configured to capture vertical support 14 and facilitate vertical movement of slide 13 with respect to frame 11 (not explicitly shown).

Figure 8:
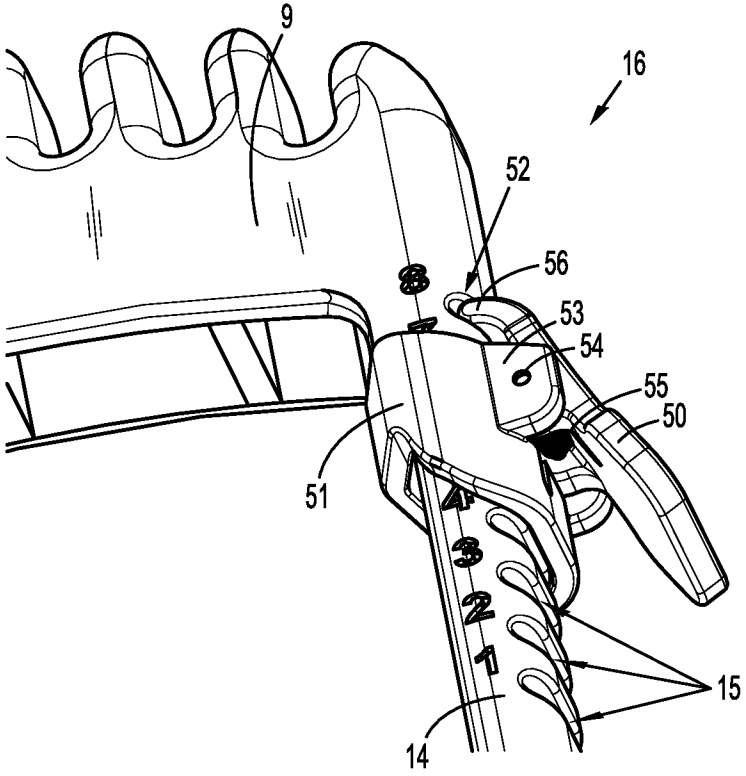
FIG. 8 is a detail view of a stopper latch in accordance with an embodiment of the present disclosure.

A pair of adjustable stoppers 16 are operatively associated with vertical supports 14. Adjustable stopper 16 includes a lever 50 which enables a user to selectively position stopper 16 at any of a plurality of positions along vertical support 14. In this manner, the upward limit of the range of motion of slide 13 may be adjusted as required. A plurality of notches 15 are defined in vertical support 14 that are configured to engage a pawl 56 provided by lever 50. Pawl 56 selectively extends though an aperture 52 defined in collar 51 to engage one of the plurality of notches 15 as best seen in FIG. 8. Lever 50 is pivotable about a pivot 54 provided by a pair of standoffs 53, and is urged by spring 55 toward an engaged position whereby pawl 56 is mechanically coupled with one of the plurality of notches 15, which, in turn, locks stopper 16 at the desired position. Each notch 15 has associated therewith a corresponding positional indicia 67, which may include, for example and without limitation, a number, a letter, or other visual indicator. Advantageously, a user or a therapist may use the positional indicia 67 (e.g., number 1-8) to determine the range of motion of the user and to establish a quantitative measurement for a user's range of motion. Such information may, for example, be placed in a user's file as a permanent record.

Advantageously, stopper 16 encases vertical support 14 to prevent loss of the stopper by the user.

A plurality of upwardly-extending posts 12*a* are provided by an upper cross-member 9 of frame 11, and plurality of downwardly-extending posts 12*b* are provided by an upper cross-member 8 of slide 13, and are configured to enable one or more elastomeric bands 26 (e.g., rubber bands) to extend between frame 11 and slide 13. As best seen in FIG. 2, the one or more elastomeric bands 26 are arranged to urge slide 13 toward frame 11. While, in FIG. 2, three elastomeric bands 26 are shown, it should be understood that the plurality of posts 12*a*, 12*b* provided by frame 11 and slide 13, respectively, will enable a user to arrange any practical number of elastomeric bands 26, of arbitrary sizes and strengths, in any desired arrangement.

In the embodiment illustrated in FIGS. 1 and 2, the slide 13 includes a rolling grip assembly 18 that includes a plurality of finger rollers 24, 24' rotatable about an axle 25 and disposed between the lower portions of supports 14. Finger rollers 24, 24' include a saddle-like profile 27 that provides an ergonomic gripping surface to facilitate grasping by the fingers F of a user's hand H. As best seen in FIG. 1, the diameter of the two inner finger rollers 24 is larger than that of the two outer finger rollers 24'. This provides a functional arch 22 that naturally forms to the fingers when compressed. The functional arch 22 automatically positions the fingers ergonomically and naturally in the manner in which a hand compresses and, in turn, allows for a more effective flexing exercise.

Finger rollers 24, 24' are free to move horizontally along axle 25. As best seen in FIGS. 1 and 2, a clearance 57 that is initially provided at either end of finger rollers 24, 24' enables finger rollers 24, 24' to automatically adjust to the size of the user's hand and/or the spacing of the user's fingers. When the fingers of the user are first placed on finger rollers 24, 24', finger rollers 24, 24' spread as determined by the size of each the fingers. During an exercise, the finger rollers 24, 24' are free to glide back and forth, self adjusting with the movement of the fingers.

Embodiments of the present disclosure are well-suited for an exercise commonly known as the "Gross Grasp" exercise. In the Gross Grasp exercise, the user extends the fingers F of the hand H, then clenches down on rolling grip assembly 18 to make a fist. Advantageously, the rolling and sliding properties of finger rollers 24, 24', the functional arch 22, the adjustability afforded by adjustable stoppers 16, and the ergonomic features of base 17 combine to provide the precise range of exercise dictated by the user's needs (hand size, range-of-motion, physical disability, etc.) while reducing friction and discomfort, which, in turn, encourages use of the exerciser and ultimately may lead to improved results.

Figure 3:
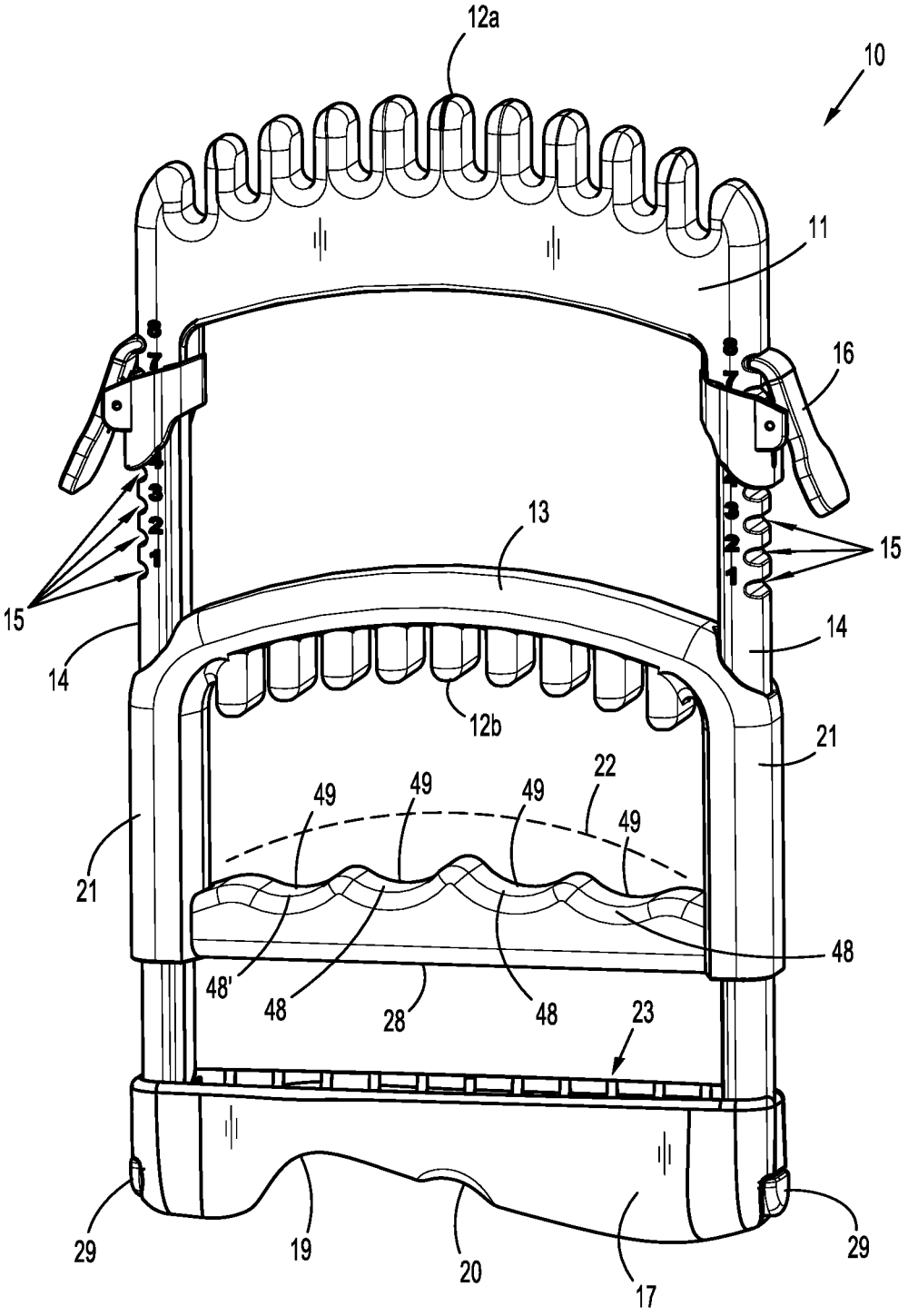
FIG. 3 is a perspective view of the improved finger exerciser of FIG. 1 with a solid arched attachment in accordance with the present disclosure.

With attention now to FIGS. 3 and 5, a slide 13 includes a pair of guides 21 that are configured to slidably engage vertical supports 14 to enable slide 13 to move up and down with respect to frame 11. In the embodiment illustrated in FIG. 3, the slide 13 includes a rigid grip assembly 28 disposed between the lower portions of supports 14. Rigid grip assembly 28 includes a plurality of finger pads 48, 48'. Finger pads 48, 48' include a scalloped or saddle-like profile 49 that provides an ergonomic surface to facilitate contact by a user's fingers or fingertips. As shown in FIG. 3, the height of the two inner finger pads 48 is greater than that of the two outer finger pads 48'. This provides the functional arch 22 that naturally meets the fingers when grasped. The functional arch 22 automatically positions the fingers in an ergonomic and natural manner which, in turn, allows for a more effective exercise.

In use, a user may easily and rapidly swap between a slide 13 having a rolling grip assembly 18 (FIGS. 1 and 2) and another slide 13 having a rigid grip assembly 28, by releasing the one or more elastomeric bands 26 from the one or more posts 12*a* and/or 12*b*, disengaging the mechanical interface 29 to release base 17 from supports 14, removing the existing slide 13 from supports 14, installing the new slide 13 onto supports 14, re-attaching the base 17 to supports 14 by re-engaging the mechanical interface, and reattaching the one or more elastomeric bands 26 to the one or more posts 12*a* and/or 12*b*.

Figure 4:
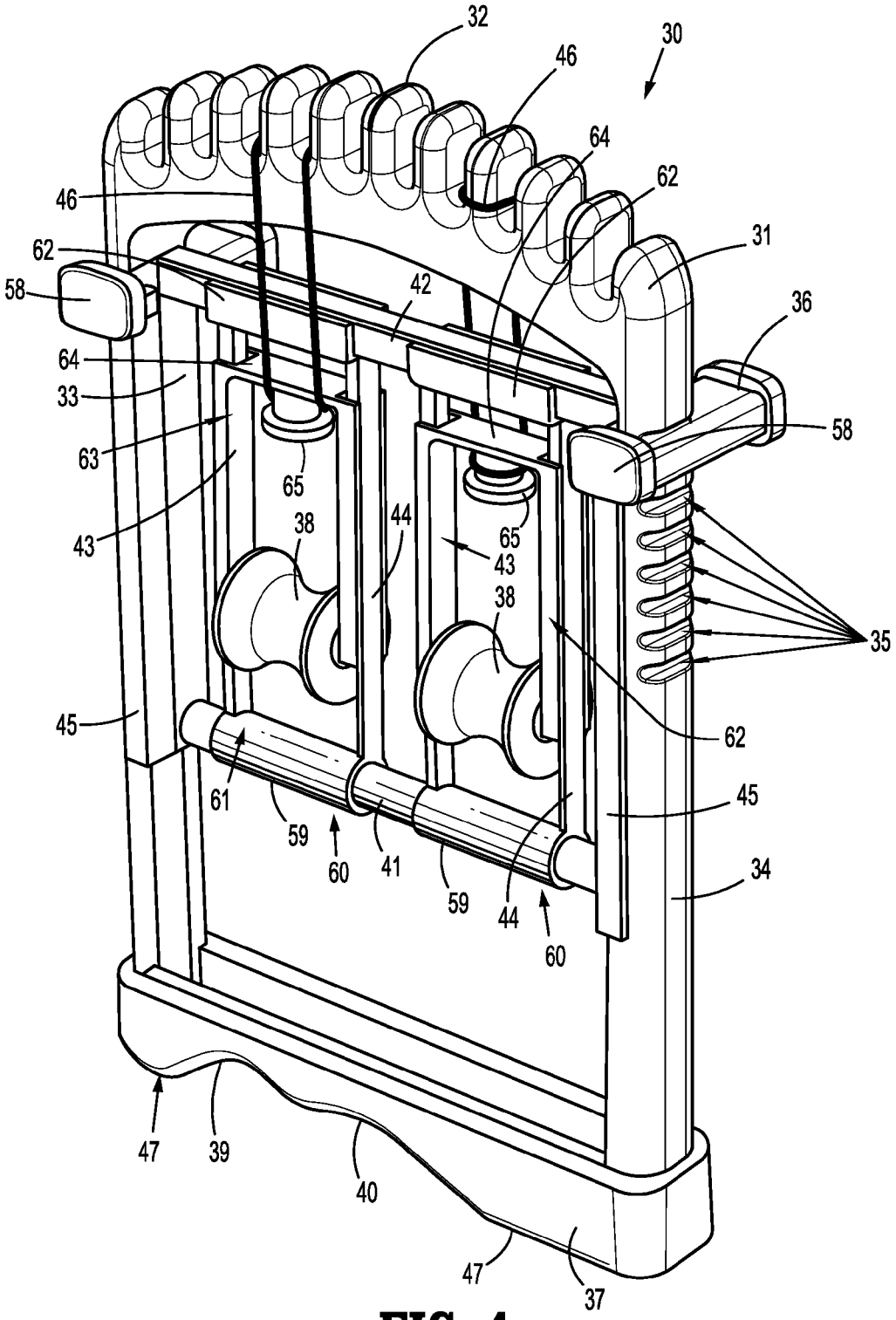
FIG. 4 is a perspective view of another embodiment of an improved finger exerciser with a plurality of individual finger exercisers in accordance with the present disclosure.
Figure 6:
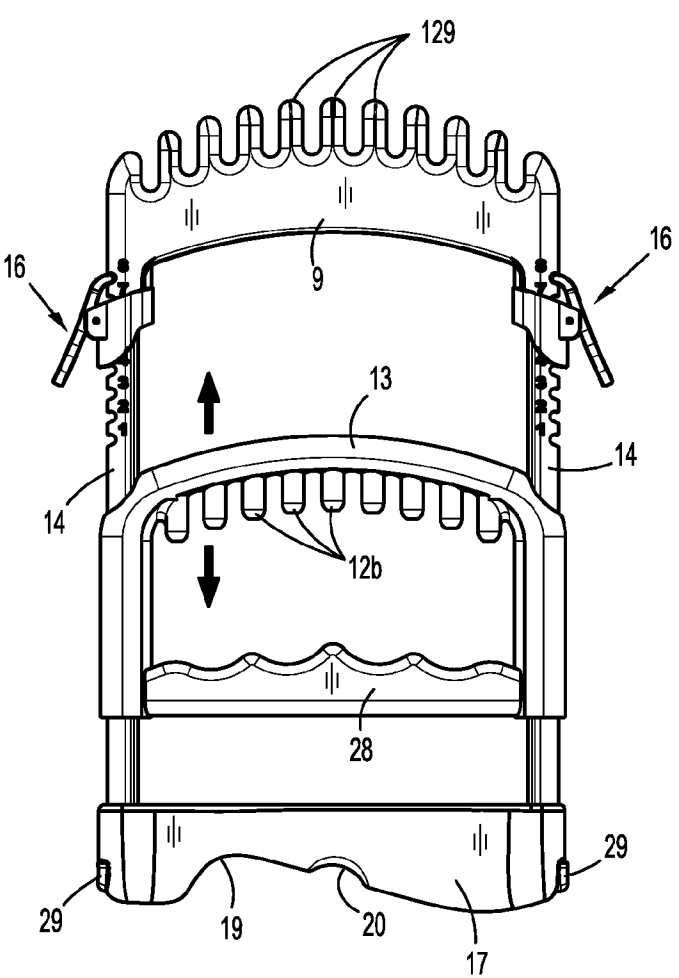
FIG. 6 is a front view of the improved finger exerciser of FIG. 1 showing a solid arched attachment and ergonomic base.

Turning to FIG. 4, another embodiment of a hand and finger exerciser 30 is presented that enables a user to exercise each finger individually (e.g., independently). Exerciser 30 includes a frame 31 on which a dual slide assembly 33 is mounted and configured for vertical motion. Frame 31 includes a pair of vertical supports 34 which extend downwardly and are fixed to a base 37. In some embodiments, vertical supports 34 are selectively attachable to base 37 enabling base 37 to be removed to facilitate reconfiguration of exerciser 30 as described above. A mechanical interface (not explicitly shown) between vertical support 14 and base 17 enables a user to selectively release and engage vertical support 14 and base 17.

Base 37 includes a number of ergonomic features configured to improve a user's grasp, to provide increased comfort, and to facilitate the use of the exerciser 30. Base 37 includes an ergonomic groove 39 defined therein that is configured to receive the base of a user's thumb. Base 37 also includes a thumb groove 40 defined therein that provides an additional grasping surface which may be utilized in various ways. For example, and without limitation, a user may place a fingertip or thumbtip in thumb groove 40 while performing "pinch" exercises as described above. Base 37 further includes flats 47 formed on either end of a bottom surface thereof to permit exerciser 30 to stand upright without assistance, which may enable various hand and finger exercises to be performed effectively.

Dual slide assembly 33 includes a pair of (e.g., left and right) guides 45 that are configured to slidably engage vertical supports 34 to enable dual slide assembly 33 to move up and down with respect to frame 31. In the embodiment illustrated in FIG. 4, left and right guides 45 include a U-channel structure which engages vertical support 34 and guides dual slide assembly 33 therealong during use. In some embodiments, guide 45 may employ a tube-like configuration that surrounds vertical support 34, a protrusion extending into a corresponding groove provided in vertical support 34 (not explicitly shown), or one or more wheels or roller bearings (not explicitly shown) configured to capture vertical support 34 and facilitate vertical movement of dual slide assembly 33 with respect to frame 31.

A pair of adjustable stoppers 36 are operatively associated with guides 45 of dual slide assembly 33. Adjustable stopper 36 includes a release button 58 which enables a user to selectively position dual slide assembly 33 at any of a plurality of positions along vertical support 34. In this manner, the desired position and range of motion of rollers 38 may be adjusted as required. A plurality of notches 35 are defined in vertical support 34 that are configured to engage a mechanical interface (not explicitly shown) provided by adjustable stopper 36, which, in turn, secures dual slide assembly 33 at the desired position.

Dual slide assembly 33 includes a lower cross-rail 41 disposed between the lower portions of the left and right guides 45, and an upper cross-rail 42 disposed between the upper portions of the left and right guides 45. A pair of individual finger exercisers 60 are disposed between lower cross-rail 41 and upper cross-rail 42, each configured for horizontal (e.g., left/right) movement along lower cross-rail 41 and upper cross-rail 42. During use, each of the pair of individual finger exercisers 60 are free to slide left and right along the lower and upper cross-rails 41, 42 which naturally positions each individual finger exerciser 60 in alignment with the user's fingers.

In more detail, each individual finger exerciser 60 includes a subframe 61 which supports a subslide 63. Each subframe 61 includes a lower subframe guide 59 configured for horizontal movement along lower cross-rail 41 and an upper subframe guide 62 configured for horizontal movement along upper cross-rail 42. A pair of vertical subframe rails 44 are joined to the left and right portions of lower subframe guide 59 and upper subframe guide 62.

Subslide 63 is captured within subframe 61 and is configured for vertical movement along vertical subframe rails 44. Subslide 63 includes a pair of vertical subslide guides 43 which ride on vertical subframe rails 44 to enable subslide 63 to move vertically. Vertical subslide guides 43 are joined at a top end thereof to subslide upper member 64, and are joined at a bottom end thereof by finger roller 38. Subslide upper member 64 includes slide post 65. A plurality of frame posts 32 are provided by frame 31. Slide post 65 and plurality of frame posts 32 are configured to support one or more elastomeric bands 46 disposed therebetween.

During use, a user may position dual slide assembly 33 to the desired position by disengaging adjustable stoppers 36 with release button 58, positioning dual slide assembly 33 at the desired position (e.g., indexed to one of the plurality of notches 35), and re-engaging adjustable stoppers 36 to lock dual slide assembly 33 in place. One or more elastomeric bands 46 may be installed between post 65 and one or more of the plurality of frame posts 32 as desired. Varying numbers and/or strengths of elastomeric bands 46 may be employed to achieve the desired resistance. The user may then begin an exercise by placing the desired finger(s) on one or both finger rollers 38, squeezing down against the resistance of elastomeric band 46, causing subslide(s) 63 to slide downward within subframe 61. Each subslide 63 is free to move independently, enabling each individual finger to receive the appropriate resistance and/or perform a distinct exercise.

Although in the example embodiment just described, dual slide assembly 33 includes two individual finger exercisers 60, it is envisioned that embodiments with greater than two, or less than two, individual finger exercisers 60 may be practiced within the scope of the present disclosure.

Figure 7:
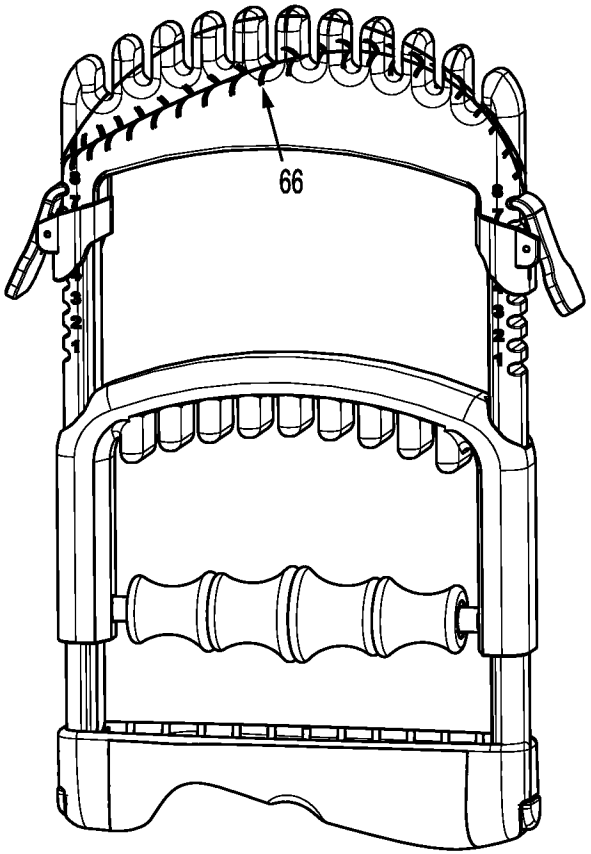
FIG. 7 is a front view of the improved finger exerciser of FIG. 1 showing a finger roller attachment and thematic graphics.
Figure 10:
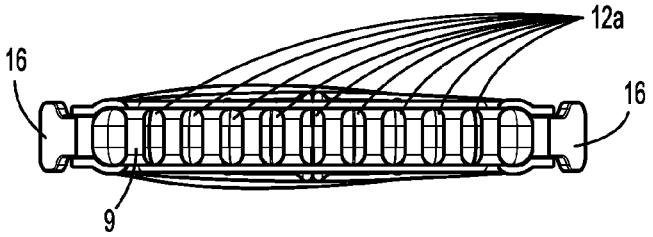
FIG. 10 is a top view of an improved finger exerciser in accordance with the present disclosure.
Figure 9:
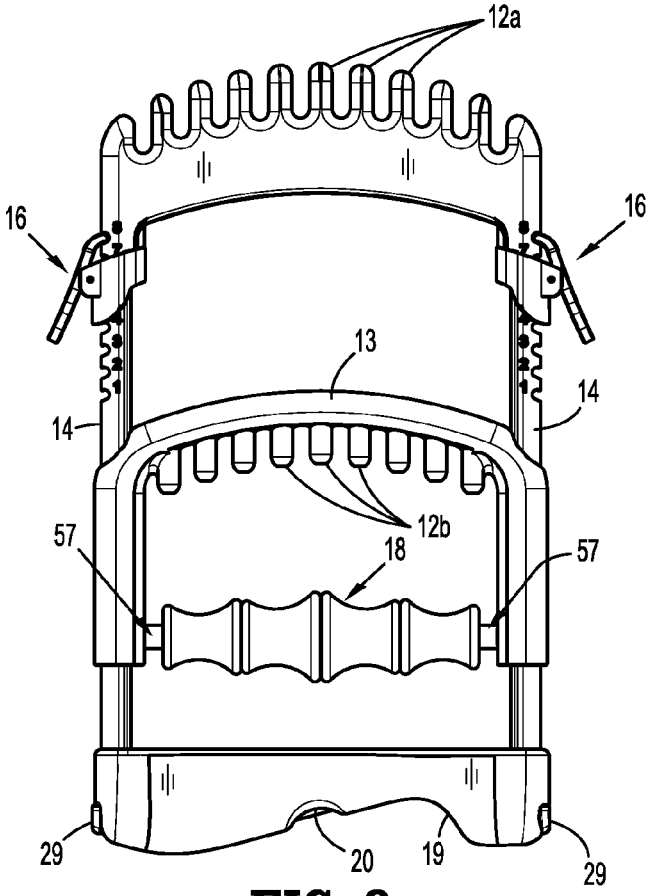
FIG. 9 is a rear view of an improved finger exerciser in accordance with the present disclosure.
Figure 12:
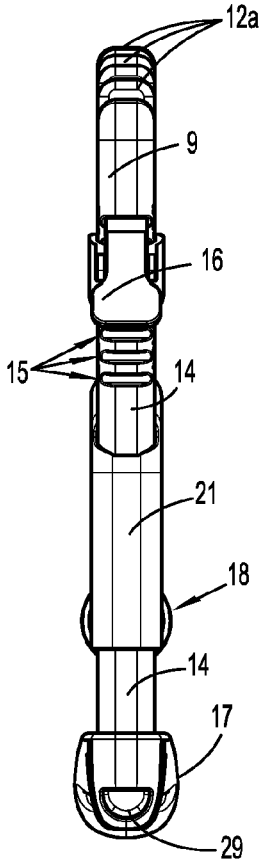
FIG. 12 is a side view of an improved finger exerciser in accordance with the present disclosure.
Figure 11:
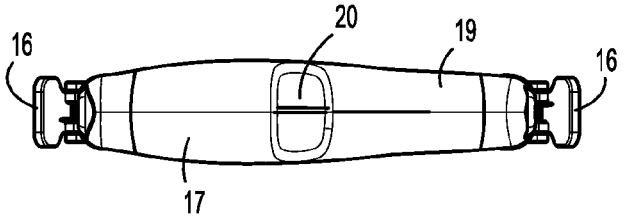
FIG. 11 is a bottom view of an improved finger exerciser in accordance with the present disclosure.

In addition, as shown in FIG. 7, embodiments in accordance with the present disclosure may include marketing graphics 66 (e.g., baseball stitches, tennis lacing, football texturing, violin f-holes, piano keys, Stratocaster® logo, etc.) to capture different markets (e.g., sports, music, rehabilitation, etc.).

The described embodiments of the present disclosure are intended to be illustrative rather than restrictive, and are not intended to represent every embodiment of the present disclosure. Further variations of the above-disclosed embodiments and other features and functions, or alternatives thereof, may be made or desirably combined into many other different systems or applications without departing from the spirit or scope of the disclosure as set forth in the following claims both literally and in equivalents recognized in law.

What is claimed is:

1. A finger exerciser, comprising:

a frame, including:

a first upper cross-member;

a pair of vertical supports extending downward from the first upper cross-member; and a base secured to a lower portion of the vertical supports;

a slide, including:

a second upper cross-member; and a pair of guides extending downward from the second upper cross-member, wherein the guides are configured to slidably engage the vertical supports of the frame to enable the slide to move vertically with respect to the frame;

one or more first posts extending upwardly from the first upper cross-member; and one or more second posts extending downwardly from the second upper cross-member, wherein the first and second posts are configured for attachment to a resistance element.

2. The finger exerciser in accordance with claim 1, wherein the base further comprises:

an ergonomic groove defined therein that is configured to receive the base of a user's thumb; and a thumb groove defined therein configured to provide an additional grasping surface.

3. The finger exerciser in accordance with claim 1, wherein the base is selectively detachable from the pair of vertical supports.

4. The finger exerciser in accordance with claim 1, wherein the base includes one or more flats formed on either end of a bottom surface thereof to enable the finger exerciser to stand upright.

5. The finger exerciser in accordance with claim 1, further comprising:

a plurality of notches defined in at least one of the pair of vertical supports; and an adjustable stopper operatively associated with the at least one of the pair of vertical supports, the adjustable stopper including a pawl configured to selectively engage one of the plurality of notches.

6. The finger exerciser in accordance with claim 1, further comprising:

an axle disposed between the lower portions of the vertical supports; and a plurality of finger rollers rotatable about the axle.

7. The finger exerciser in accordance with claim 6, wherein the plurality of finger rollers includes:

a pair of inner finger rollers; and a pair of outer finger rollers having a diameter that is smaller than a corresponding diameter of the inner finger rollers.

8. The finger exerciser in accordance with claim 6, wherein each of the plurality of finger rollers includes a saddle-like profile.

9. The finger exerciser in accordance with claim 6, wherein each of the plurality of finger rollers are free to move horizontally along at least a portion of the axle.

10. The finger exerciser in accordance with claim 1, further comprising a rigid grip assembly disposed between the lower portions of the vertical supports.

11. The finger exerciser in accordance with claim 10, wherein the rigid grip assembly includes a plurality of finger pads.

12. The finger exerciser in accordance with claim 11, wherein the plurality of finger pads further comprises:

two inner finger pads; and two outer finger pads having a height less than a corresponding height of the two inner pads.

* * * * *